US006554417B2

(12) United States Patent
Lin et al.

(10) Patent No.: US 6,554,417 B2
(45) Date of Patent: Apr. 29, 2003

(54) RECORDING MEDIUM CONVEYING DEVICE AND AN INK JET PRINTING DEVICE USING THE SAME

(75) Inventors: Tsung-Te Lin, Taipei (TW); Ying-Hsien Kuo, Taipei (TW); Yen-Sung Hsieh, Taipei (TW)

(73) Assignee: Benq Corporatiion, Taoyuan (TW)

( * ) Notice: Subject to any disclaimer, the term of this patent is extended or adjusted under 35 U.S.C. 154(b) by 0 days.

(21) Appl. No.: 10/038,611

(22) Filed: Jan. 8, 2002

(65) Prior Publication Data

US 2002/0145656 A1 Oct. 10, 2002

(30) Foreign Application Priority Data

Apr. 9, 2001 (TW) ..... 90108458 A

(51) Int. Cl.[7] ..... B41J 2/01

(52) U.S. Cl. ..... 347/104

(58) Field of Search ..... 347/104, 85, 11, 347/68, 94; 137/859, 513.7, 855; 399/361; 400/578; 346/134

(56) References Cited

U.S. PATENT DOCUMENTS 5,420,621 A 5/1995 Richtsmeier et al.
5,606,357 A 2/1997 Bekki

*Primary Examiner*—Raquel Yvette Gordon
(74) *Attorney, Agent, or Firm*—Greenblum & Bernstein, P.L.C.

(57) ABSTRACT

A recording medium conveying device for an ink jet printing device comprises an active roller, a starwheel and an elastic cantilever beam, so that when the starwheel presses against the active roller, the recording medium is conveyed due to the rolling of the active roller, and is not substantially damaged.

11 Claims, 8 Drawing Sheets

RECORDING MEDIUM CONVEYING DEVICE AND AN INK JET PRINTING DEVICE USING THE SAME

FIELD OF THE INVENTION

The present invention relates to a recording medium conveying device, especially to a recording medium conveying device for an ink jet printing device.

BACKGROUND OF THE INVENTION

After a recording medium is printed by an ink jet printing device, such as an ink jet printer, an ink jet copy machine and an ink jet fax machine, the ink on the recording medium is still wet when being conveyed out of the ink jet printing device. If the recording medium is conveyed at the outlet by using two sets of rollers, chance is very much that the printed portions and the unprinted portions would be stained. The wet ink from the printed portion first taints the rollers, then the ink from the roller may in turn stain other printed portions and unprinted ones.

To counter this effect, besides quick-drying ink, the starwheel structure is also proposed. A starwheel has multiple tiny teeth on the rim. These teeth retain only infinitesimal amount of ink and hardly stain the recording medium. However, the tiny teeth on the edge of the starwheel tend to damage the recording medium due to the large local stress. Two of the structures disclosed in prior arts in order to maintain appropriate application of force on the recording medium are briefly described in the following paragraphs.

Please refer to FIG. 1(*a*). Brent et al, in U.S. Pat. No. 5,420,621, provides a structure of pinch wheels 101. Each pinch wheel 101 includes two connected starwheels mounted at the front end of a cantilever beam 102. At the back end of the cantilever beam 102 is placed a yoke 103. The yoke 103 receives the outer pin 104 located on the housing of a printing device and an L-shaped spring 105 provides appropriate force so that the pin on the pinch wheel would not pierce or damage the surface of the recording medium. A cantilever beam, a yoke, a pinch wheel and a spring are required to be correctly assembled. The pinch wheel, however, may demand some special assembly efforts and thus the assembly rate and productivity are downgraded.

Please refer to FIG. 1(*b*). In U.S. Pat. No. 5,606,357 invented by Toshihiko Bekki et al, a spur 107 supported by a coil spring 106 is disclosed. The spur 107 has a structure similar with the starwheel. Compared with the prior art described above, the most significant change is that Toshihiko adopted the coil spring 106. The elasticity of the coil spring 106 provides adequate force on the double starwheels so that the teeth on the double starwheels would not pierce or damage the surface of the recording medium. Though being creative on using the coil spring as the shaft, however, the coil spring is apt to fall apart when rolling. Moreover, owning to the small size and enforcement on both sides of the coil spring, the assembly process is inefficient and difficult.

SUMMARY OF THE INVENTION

In order to straighten out all those defects in the prior arts depicted above, the present invention proposes a recording medium conveying device. In one embodiment of the present invention, a cantilever beam integral with the ink jet printing device is adopted. The cantilever beam is provided with multiple supporting device and a stress concentration zone. The cantilever beam, by employing its elasticilty, holds a starwheel mounted at one end of the cantilever beam and a recording medium in contact and maintains the intactness of the recording medium. The stress concentration area limits the stress within area. In the first preferred embodiment, since the cantilever beam is integrated with the housing, the structure is well constructed after the starwheel is in place.

On the other hand, in the second preferred embodiment of the present invention, an elastic connective connects a star ring and a shaft to form a rotatable starwheel. The elastic connective holds the starwheel and the recording medium in appropriate contact without damaging the recording medium, even if the mount (eg. the cantilever beam) is substantially rigid.

The two embodiments are ready for combination to form a double-elastic structure having both an elastic cantilever beam and an elastic connective.

BRIEF DESCRIPTION OF THE DRAWINGS

FIG.1(*b*) discloses another recording medium conveying device in another prior art;

FIG. 4(*b*) is a schematic diagram of the recording medium conveying device according to the first preferred embodiment of the present invention when conveying a thick recording medium;

FIG. 7(*b*) is a schematic diagram of the recording medium according the second preferred embodiment of the present invention when conveying a thick recording medium.

DETAILED DESCRIPTION OF THE INVENTION

Figure 1A:
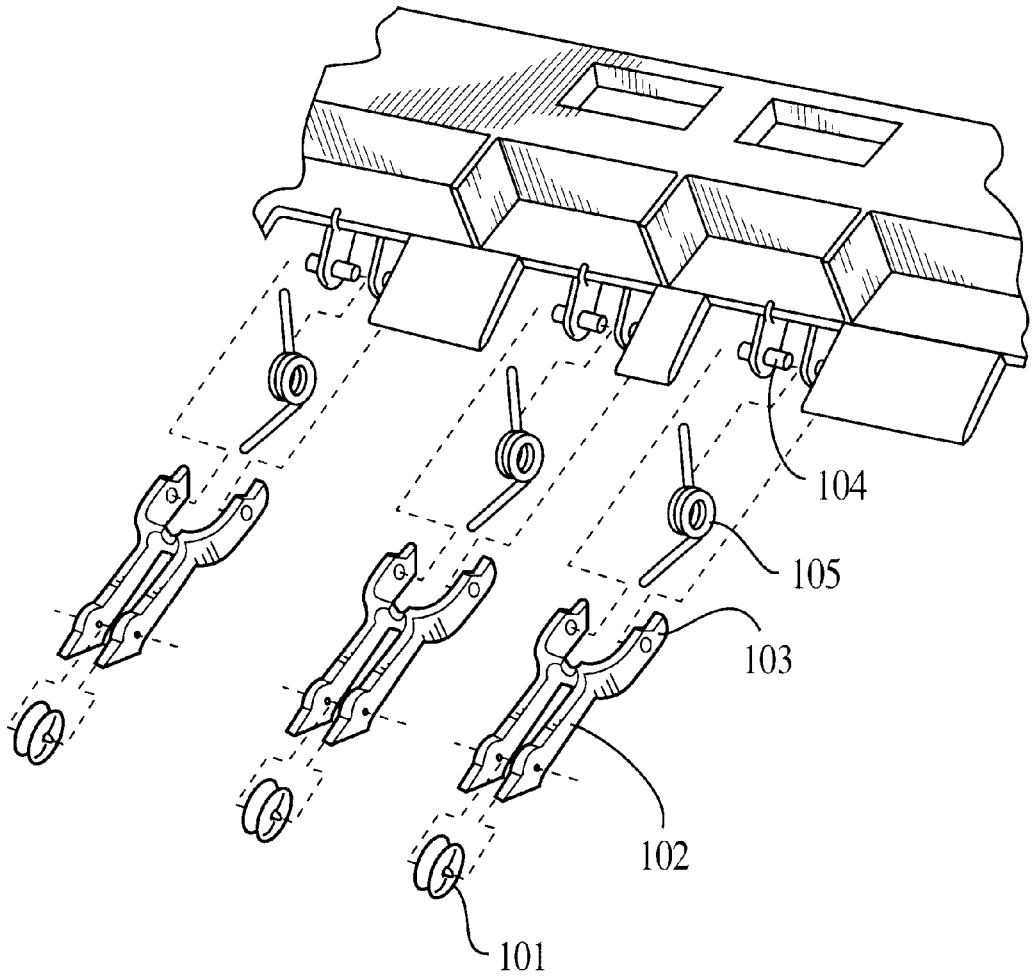
FIG. 1a PRIOR ART
FIG. 1(*a*) discloses a recording medium conveying device in a prior art.
Figure 1B:
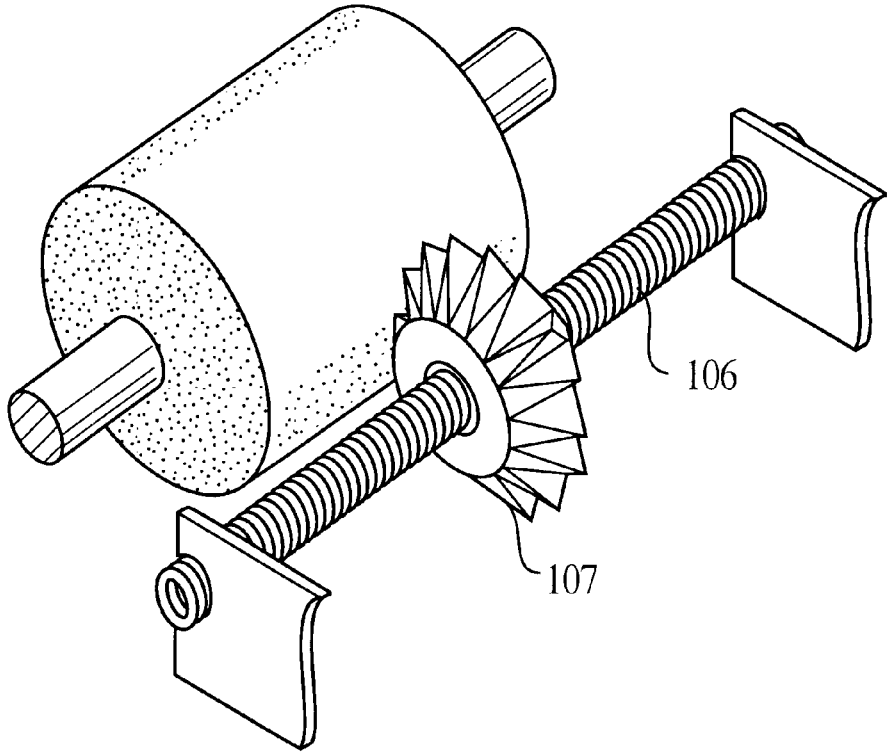
FIG. 1b PRIOR ART
Figure 2:
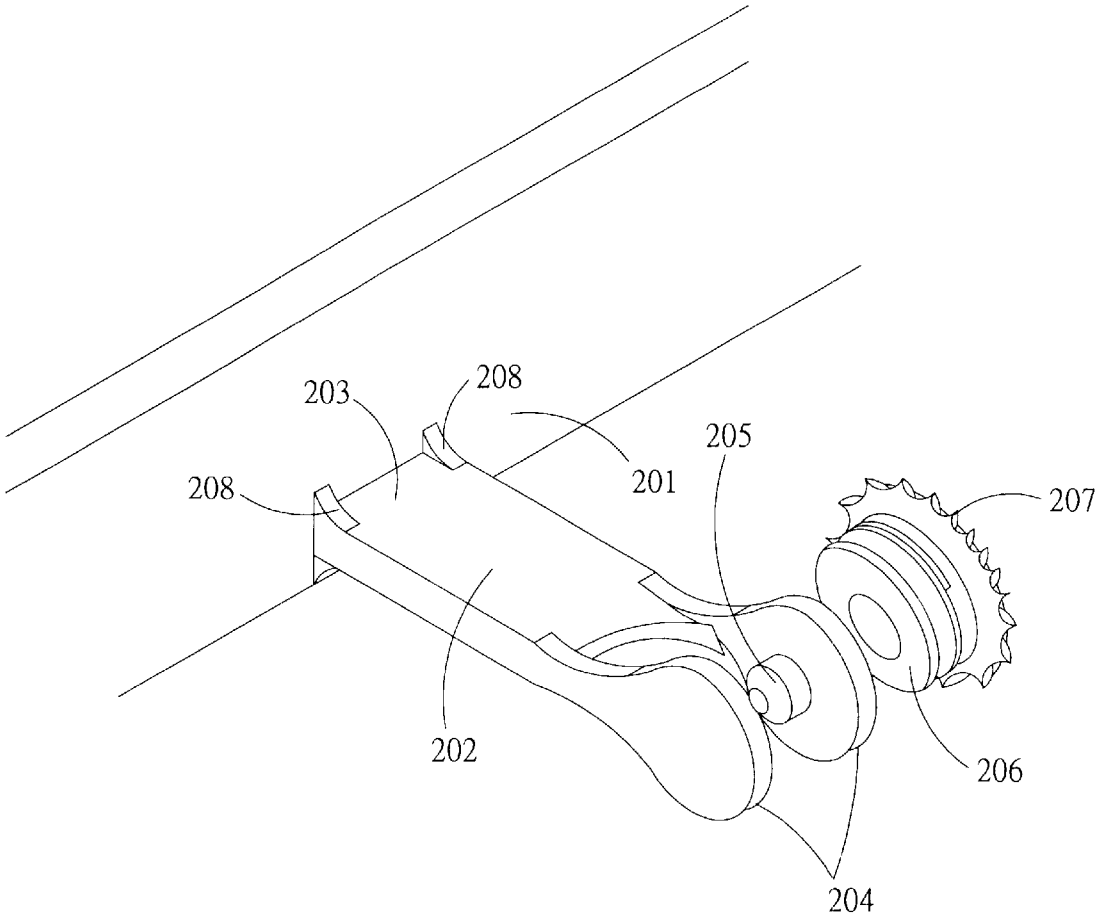
FIG. 2 is a schematic diagram of the cantilever beam and the starwheel according to the first preferred embodiment of the present invention.

The present invention provides a recording medium conveying device for ink jet printing device. The recording medium conveying device is easy to assemble and highly reliable, rightfully solving the problems encountered by the state of the art. Please refer to FIG. 2, which is a schematic diagram of the recording medium conveying device according to the first embodiment of the present invention. An elastic cantilever beam 202 is installed on the housing part 201 of the ink jet printing device and the elastic cantilever beam 202 is integral with the housing part 201. The elastic cantilever beam 202 has a fixed end 203 and a free end 204. The fixed end 203 is integral with the housing part 201 in a fixed fashion. The free end 204 has a shape of a yoke having two outer pins 205 (one not shown) for mounting the starwheel 206. The starwheel 206 has a set of teeth 207 on the rim of the starwheel 206. The starwheel 206 has a hole passing through (or not passing through) the center, capable of receiving the outer pins 205.

In this manner, the starwheel 206 is freely rotatable after mounting on the free end 204. Any other arrangements allowing free rotation of the starwheel 206 are also applicable. For example, the starwheel 206 may have outer pins and the outer pins 205 on the free end 204 may be replaced by a through hole. Thus, the starwheel 206 could be mounted on the free end 204 and is freely rotatable.

Typically the housing parts are made of ABS or other polymeric materials having elasticity thereof. Especially when the thickness variation of the recording medium is limited, the cantilever beam 202 made by the same material properly maintains the force of starwheel 206 on the recording medium. The up and down movement is harmful to the connection between the fixed end 203 and the housing part 201. Bearing this in mind, multiple supporting devices 208 are provided at the junction of the fixed end 203 and housing part 201, so as to fortify the connection between the fixed end 203 and the housing part 201.

Figure 3:
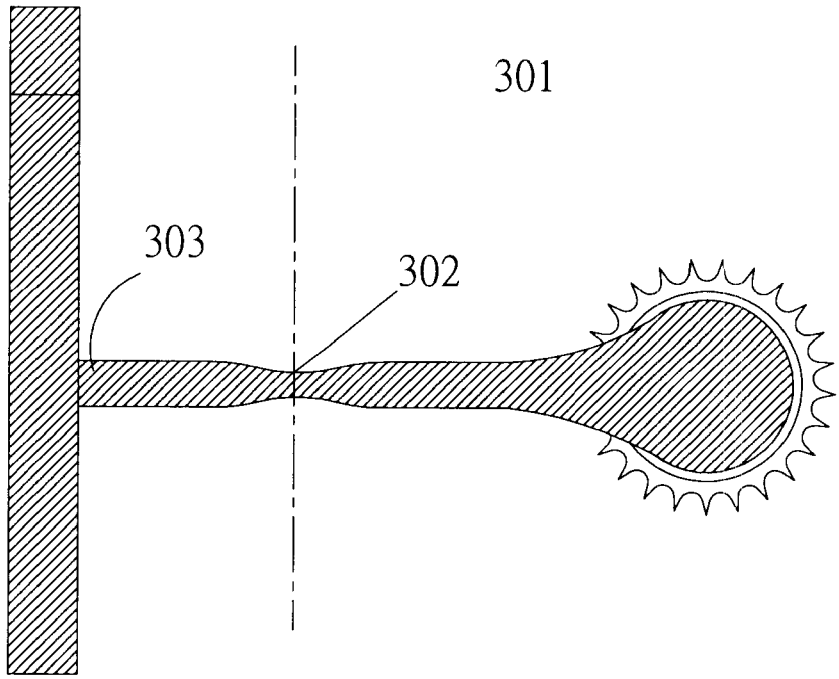
FIG. 3 is the side view of the recording medium conveying device according to the first preferred embodiment of the present invention.

Refer now to FIG. 3, the cantilever beam 301 has a stress concentration area 302. The stress concentration area 302 may have a thinner thickness or narrower width, such that strain centralizes in the stress concentration area 302. The supporting device 303 does not extend to or cross the stress concentration area 302 to ensure the stress is trapped in the stress concentration area 302.

Figure 4A:
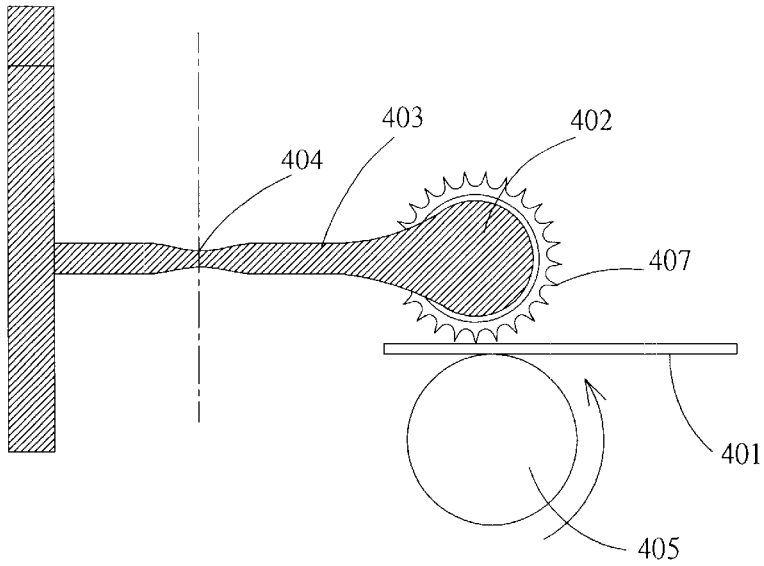
FIG. 4(*a*) is a schematic diagram of the recording medium conveying device according to the first preferred embodiment of the present invention when conveying a thin recording medium.
Figure 4B:
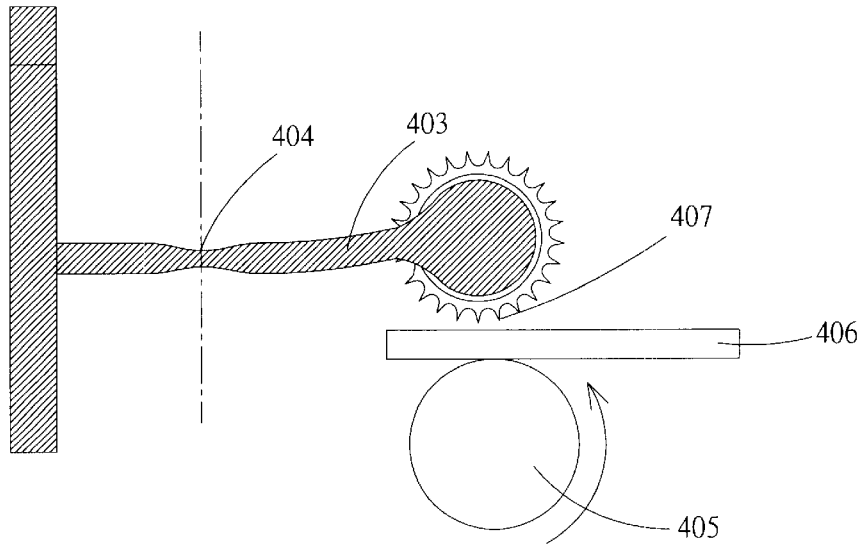

When conveying the recording medium, the starwheel presses the recording medium against the active roller. Once the active roller rotates, the recording medium is conveyed toward a specific direction. The schematic diagrams of the recording medium conveying device when conveying thin and thick recording media are given in FIGS. 4(*a*) and 4(*b*). As shown by FIG. 4(*a*), when conveying a thin recording medium 401, the cantilever beam 403 loaded with a starwheel 402 only slightly deforms in the stress concentration area 404. The starwheel 402 presses the tin recording medium 401 onto the roller 405. When the roller 405 rotates, the thin recording medium 401 is conveyed. When conveying a thick recording medium 406, as shown in FIG. 4(*b*), the cantilever beam 403 deforms in a larger scale in the stress concentration area 404 and still presses the thick recording medium 406 against the roller 405. When the roller 405 rotates, the thick recording medium 406 is therefore conveyed. The cantilever beam 403 has specific dimensions to ensure the teeth 407 shall not damage the recording media, no matter thin or thick.

According to the first preferred embodiment of the present invention, the recording medium conveying device makes use of the housing part extension and the shape changes thereof to provide the appropriate force of the starwheel on the recording medium. Different materials from the housing and complicated structures are not required in this embodiment.

In the second preferred embodiment, an elastic connective is inserted between a rigid shaft and a rigid star ring. The elastic connective had better be made of rubber and the rubber preferably has a Shore hardness between A20 and A40. The hardness and dimensions have to be carefully selected so that the teeth on the rim of the starwheel does not damage the recording medium.

Figure 5:
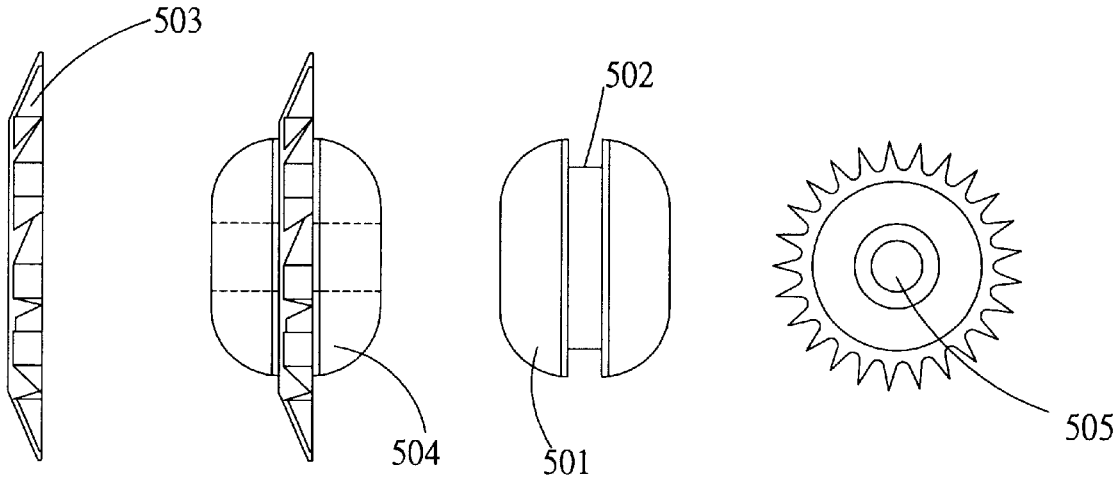
FIG. 5 is a schematic diagram of the starwheel and the elastic connective according to the second preferred embodiment of the present invention.
Figure 6:
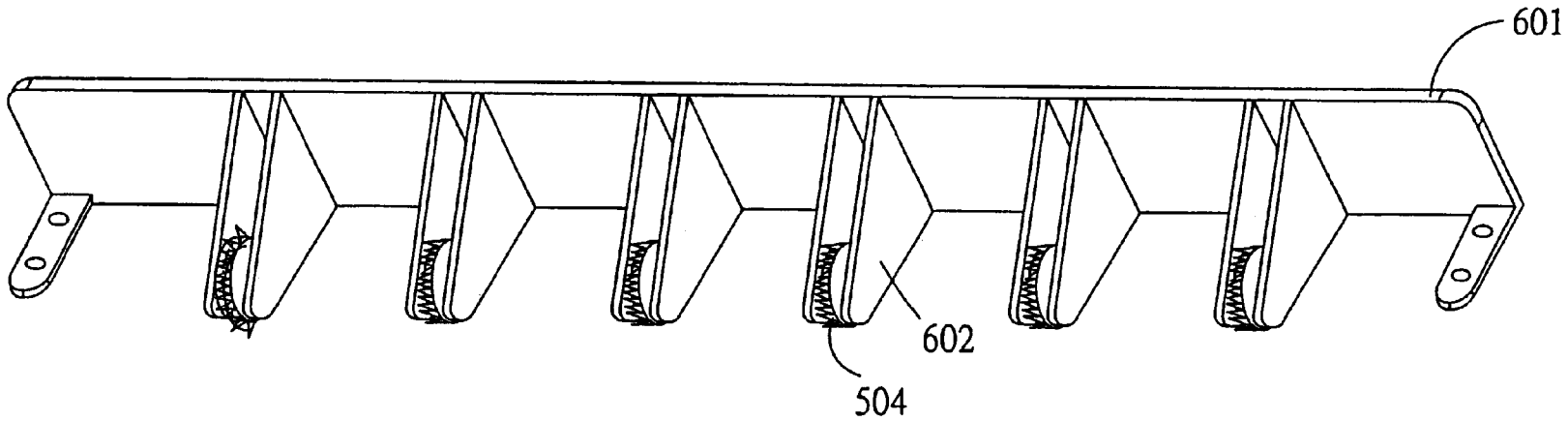
FIG. 6 is a schematic diagram of the starwheel connected with a frame according the second embodiment of the present invention.

Refer now to FIG. 5, where a schematic diagram of the recording medium conveying device according to the second preferred embodiment is illustrated. An elastic connective 501 has a fillister 502 on the radial lateral. A star ring 503 has an inside radius substantially equal to the distance from the bottom of the fillister 502 to the center of the elastic connective 501. In this way, the fillister 502 exactly wedges the star ring 503. A starwheel 504 is then formed after the star ring 503 is wedged in the fillister 502. At the center of the starwheel 504 is an axial through hole 505. Please refer to FIG. 6. Multiple Frames 602 are also installed on the housing part 601. An outer pin (not shown) is located at the far end of the frame 602 from the housing part 601 and is ready to be received by the axial through hole 505. The starwheel 504 is freely rotatable when being mounted on the frames 602.

The arrangement as described above is for the sake that the starwheel 504 is freely rotatable when being mounted on the frames 602. Any other arrangements and combinations fulfilling this requirement can be adopted. For example, the starwheel 504 has a perpendicularly extending outer pin (not shown) at the center and the outer pin at the far end of the frame 602 is replaced by a through hole. The starwheel 504 can still be installed on the frame 602 and freely rotate.

Figure 7A:
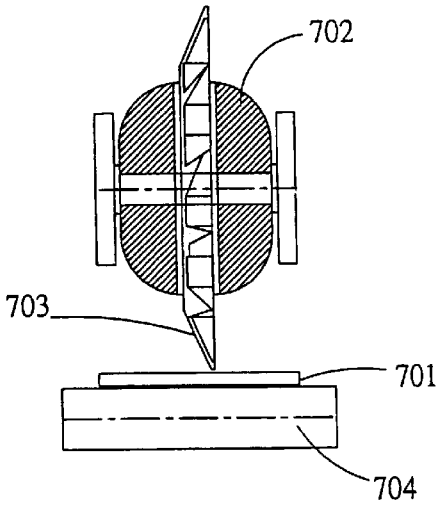
FIG. 7(*a*) is a schematic diagram of the recording medium according the second preferred embodiment of the present invention when conveying a thin recording medium.
Figure 7B:
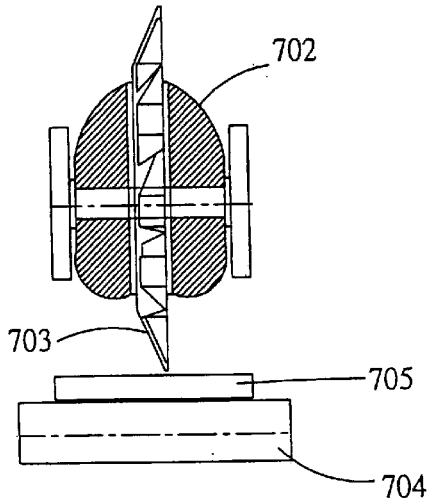

FIG. 7(*a*) and FIG. 7(*b*) illustrate the deformation of the elastic connective of the starwheel according to the second preferred embodiment when conveying recording media of different thickness. Please refer to FIG. 7(*a*), when conveying a thin recording medium 701, the elastic connective 702 only slightly deforms. In order to convey recording media, the star ring 703 presses the thin recording medium 701 against the active roller 704. When the active roller rotates, the thin recording medium 701 is thus conveyed. Please refer to FIG. 7(*b*), when conveying a thick recording medium 705, the elastic connective 702 deforms more distinguishably. The star ring 703 presses the thick recording medium 705 against the active roller 704. When the active roller 704 rotates, the thick recording medium 705 is thus conveyed.

The third preferred embodiment of the present invention is a combination of the first and the second preferred embodiment. The starwheel in the first preferred embodiment is replaced by the starwheel made of an elastic connective and a star ring in the second preferred embodiment. Being such arranged, the recording medium conveying device has two deformable region. One of them is the stress concentration area and the other is the elastic connective.

Since the number of deformable area increases, the strain within these two regions could be reduced. It in turn means that the stress concentration area could be stronger and the rubber of the elastic connective could be harder. The durability and performance can then be better balanced.

While this invention has been described in terms of several preferred embodiments, there are many alternatives, permutations, and equivalents which fall within the scope of this invention. It should also be noted that there are many alternative ways of implementing the methods and apparatuses of the present invention. It is therefore intended that the following appended claims should be interpreted as including all such alternations, permutations, and equivalents as fall within the true spirit and scope of the present invention.

We claim:

1. A recording medium conveying device for an ink jet printing device, said ink jet printing device having a housing, said recording medium conveying device comprising:

an active roller;

a starwheel, said starwheel having a set of teeth for contacting a recording medium just printed, so that when said starwheel presses said recording medium against said active roller, said recording medium being conveyed due to the rolling of the active roller; and an elastic cantilever beam for supporting said starwheel, said elastic cantilever beam having a fixed end and a free end, said fixed end being firmly connected with the housing of said ink jet printing device, and said free end having a mount thereon, said starwheel connected with said mount;

wherein the free end of said elastic cantilever beam is allowed to move up and down, so that when said starwheel rotates, the free end of said elastic cantilever beam moving according to the thickness of said recording medium and the set of teeth on said starwheel remaining in substantially appropriate contact with said recording medium without damaging said recording medium.

2. The recording medium conveying device as depicted in claim 1, wherein said elastic cantilever beam is a board-like structure perpendicular to said housing, the joint of the fixed end and said housing having multiple supporting devices to fortify the fixed end of said elastic cantilever beam.

3. The recording medium conveying device as depicted in claim 2, wherein said elastic cantilever beam further comprises a stress concentration area, said stress concentration area located between the free end and the fixed end, the stress concentration area having thickness thereof smaller than the thickness of other areas of the elastic cantilever beam, and said multiple supporting devices not extending into said stress concentration area.

4. A recording medium conveying device for an ink jet printing device, said ink jet printing device having a housing, said recording medium conveying device comprising:

an active roller;

a frame connected with said housing of the ink jet printing device;

a rolling shaft located on the frame;

a star ring, said star ring having a set of teeth for contacting a recording medium just printed, so that when said star ring presses said recording medium against said active roller, said recording medium being conveyed due to the rolling of the active roller; and an elastic connective for connecting said rolling shaft and said star ring, forming a starwheel rotatable around the axis of said star ring;

wherein said elastic connective, responsive to stress deforms when bearing stress, so that said star ring moving relative to said rolling shaft according to the thickness of said recording medium, when said starwheel rotates, said set of teeth remaining in substantially appropriate contact with said recording medium without damaging the recording medium.

5. The recording medium conveying device as depicted in claim 4, wherein said frame is an elastic cantilever beam, said elastic cantilever beam having a fixed end and a free end, said fixed end being firmly connected with the housing of said ink jet printing device, and said free end having a mount thereon for holding said starwheel, said elastic cantilever beam being allowed to move up and down, so that when said starwheel rotates, the free end of said elastic cantilever beam moving according to the thickness of said recording medium and the set of teeth on said starwheel remaining in substantially appropriate contact with said recording medium without damaging said recording medium.

6. The recording medium conveying device as depicted in claim 5, wherein said elastic cantilever beam is a board-like structure perpendicular to said housing, the joint of the fixed end and said housing having multiple supporting devices to fortify the fixed end of said elastic cantilever beam.

7. The recording medium conveying device as depicted in claim 6, wherein said elastic cantilever beam further comprises a stress concentration area, said stress concentration area located between the free end and the fixed end, the stress concentration area having thickness thereof smaller than the thickness of other areas of the elastic cantilever beam, and said multiple supporting devices not extending into the said stress concentration area.

8. The recording medium conveying device as depicted in claim 4, wherein said elastic connective has a radial lateral and two circular axial surfaces, in the middle of said radial lateral having in the middle a fillister for wedging said star ring, a hole passing through said two circular axial surfaces for accomodating said rolling shaft.

9. The recording medium conveying device as depicted in claim 8, wherein said elastic connective is made of rubber.

10. An ink jet printing device comprising a recording medium conveying device, said ink jet printing device having a housing, said recording medium conveying device comprising:

an active roller;

a starwheel, said starwheel having a set of teeth for contacting a recording medium just printed, so that when said starwheel presses said recording medium against said active roller, said recording medium being conveyed due to the rolling of the active roller; and an elastic cantilever beam for supporting said starwheel, said elastic cantilever beam having a fixed end and a free end, said fixed end being connected with the housing of said ink jet printing device in a fixed fashion, and said free end having a mount thereon, said starwheel connected with said mount;

wherein the free end of said elastic cantilever beam is allowed to move up and down, so that when said starwheel rotates, the free end of said elastic cantilever beam moving according to the thickness of said recording medium and the set of teeth on said starwheel remaining in substantially appropriate contact with said recording medium without damaging said recording medium.

11. An ink jet printing device comprising a recording medium conveying device, said ink jet printing device having a housing, said recording medium conveying device comprising:

an active roller;

a frame connected with said housing of the ink jet printing device;

a rolling shaft located on the frame;

a star ring, said star ring having a set of teeth for contacting a recording medium just printed, so that when said star ring presses said recording medium against said active roller, said recording medium being conveyed due to the rolling of the active roller; and an elastic connective for connecting said rolling shaft and said star ring, forming a starwheel rotatable around the axis of said star ring;

wherein said elastic connective deforms when bearing stress, so that said star ring moving relative to said shaft according to the thickness of said recording medium, when said starwheel rotates, said set of teeth remaining in substantially appropriate contact with said recording medium without damaging the recording medium.

* * * * *